US009778586B2

(12) United States Patent
Kinoshita et al.

(10) Patent No.: US 9,778,586 B2
(45) Date of Patent: Oct. 3, 2017

(54) CORE MATERIAL OF MAGNETIC CARRIER FOR ELECTROPHOTOGRAPHIC DEVELOPER AND PROCESS FOR PRODUCING THE SAME, MAGNETIC CARRIER FOR ELECTROPHOTOGRAPHIC DEVELOPER, AND TWO-COMPONENT SYSTEM DEVELOPER

(75) Inventors: Kaori Kinoshita, Otake (JP); Eiichi Kurita, Otake (JP)

(73) Assignee: TODA GOKYO CORPORATION, Hiroshima (JP)

( * ) Notice: Subject to any disclaimer, the term of this patent is extended or adjusted under 35 U.S.C. 154(b) by 0 days.

(21) Appl. No.: 14/111,587

(22) PCT Filed: Apr. 12, 2012

(86) PCT No.: PCT/JP2012/060061

§ 371 (c)(1),
(2), (4) Date: Nov. 12, 2013

(87) PCT Pub. No.: WO2012/141260

PCT Pub. Date: Oct. 18, 2012

(65) Prior Publication Data

US 2014/0065535 A1 Mar. 6, 2014

(30) Foreign Application Priority Data

Apr. 14, 2011 (JP) ..... 2011-089738

(51) Int. Cl.

*G03G 9/113* (2006.01)
*G03G 9/107* (2006.01)
*G03G 9/08* (2006.01)

(52) U.S. Cl.

CPC ..... *G03G 9/107* (2013.01); *G03G 9/0804* (2013.01); *G03G 9/1075* (2013.01); *G03G 9/113* (2013.01); *G03G 9/1133* (2013.01); *G03G 9/1135* (2013.01); *G03G 9/1136* (2013.01)

(58) Field of Classification Search

USPC ..... 430/111.31, 111.32, 111.35
See application file for complete search history.

(56) References Cited

U.S. PATENT DOCUMENTS

| | | | | |
|---|---|---|---|---|
| 6,312,862 | B1 | 11/2001 | Okado et al. | |
| 6,506,531 | B1 | 1/2003 | Hakata et al. | |
| 2009/0311617 | A1 | 12/2009 | Uemoto et al. | |
| 2010/0196818 | A1* | 8/2010 | Kojima et al. | 430/111.32 |
| 2012/0115078 | A1 | 5/2012 | Kinoshita et al. | |
| 2012/0129087 | A1* | 5/2012 | Iwami et al. | 430/106.2 |

FOREIGN PATENT DOCUMENTS

| | | | |
|---|---|---|---|
| EP | 0 999 478 A1 | 5/2000 | |
| JP | 2008-181162 | 8/2008 | |
| JP | 2009-294253 | 12/2009 | |
| JP | 2010-55086 | 3/2010 | |
| JP | 2011-2497 | 1/2011 | |
| JP | 2011-13676 | 1/2011 | |
| WO | WO 2010/140677 | * 12/2010 | G03G 9/113 |

OTHER PUBLICATIONS

Extended European Search Report in EP 12 77 1219 dated Sep. 1, 2014.
International Search Report for PCT/JP2012/60061, mailed May 22, 2012.
International Preliminary Examination Report (English version) in PCT/JP2012/060061 dated Oct. 24, 2013.

* cited by examiner

*Primary Examiner* — Peter Vajda
(74) *Attorney, Agent, or Firm* — Nixon & Vanderhye P.C.

(57) ABSTRACT

The present invention provides a magnetic carrier for an electrophotographic developer which has an excellent durability and a stable charging property and is free from occurrence of spent toner thereonto, and a two-component system developer comprising the magnetic carrier for an electrophotographic developer and a toner. The present invention relates to a core material of a magnetic carrier for an electrophotographic developer comprising spherical composite particles comprising at least ferromagnetic iron oxide fine particles and a cured phenol resin and having an average particle diameter of 1 to 100 μm, a resin index of the spherical composite particles being within the range of 35 to 80%, and a magnetic carrier obtained by coating a surface of respective particles of the magnetic carrier core material with a resin.

11 Claims, No Drawings

CORE MATERIAL OF MAGNETIC CARRIER FOR ELECTROPHOTOGRAPHIC DEVELOPER AND PROCESS FOR PRODUCING THE SAME, MAGNETIC CARRIER FOR ELECTROPHOTOGRAPHIC DEVELOPER, AND TWO-COMPONENT SYSTEM DEVELOPER

This application is the U.S. national phase of International Application No. PCT/JP2012/60061 filed 12 Apr. 2012 which designated the U.S. and claims priority to JP 2011-089738 filed 14 Apr. 2011, the entire contents of each of which are hereby incorporated by reference.

TECHNICAL FIELD

The present invention relates to a magnetic carrier for an electrophotographic developer having an excellent durability in which a coating resin is allowed to strongly adhere onto a surface of respective core material particles for the magnetic carrier, the coating resin layer is free from peeing-off and abrasion, and occurrence of spent toner onto the magnetic carrier is suppressed, as well as a two-component system developer comprising the magnetic carrier for an electrophotographic developer and a toner.

BACKGROUND ART

As is well known in the art, in electrophotographic developing methods, in general, a photoreceptor formed of a photoconductive material such as selenium, OPC (organic semiconductor), a-Si or the like has been used to form an electrostatic latent image thereon by various means. Then, by using a magnetic brush developing or the like, a toner charged with a polarity reverse to that of the latent image is attached thereonto by an electrostatic force to develop the latent image.

In the above developing step, there is used a two-component system developer comprising a toner and a carrier. The carrying particles called the carrier acts for imparting an appropriate positive or negative electric charge amount to the toner by frictional electrification, and delivering the toner into a developing zone near the surface of the photosensitive member on which the latent image is formed, by a developing sleeve in which magnets are accommodated, using a magnetic force thereof.

The electrophotography has been frequently used in extensive applications such as copying machines and printers. In recent years, there is an increasing demand for these equipments having a high image quality. In these application fields, with the increase in image quality, reduction in particle size of a developer used therein as well as increase in a copying or printing speed have proceeded. For this reason, a stress applied onto the developer tends to be increased, so that a large problem tends to be posed on difficulty in maintaining good characteristics of the developer.

With the market's requirements for personalization and space saving, etc., reduction in size of the electrophotographic image-forming apparatuses such as copying machines and printers has been promoted. with the reduction in size of these apparatuses, respective units thereof have also been required to have a reduced size. Thus, it has been required to provide a small-size developing device, i.e., maintain good developing characteristics of a developer used therein even when used in a small amount.

In general, in the apparatuses having a small size, in order to reduce an amount of an electric power consumed, there is a demand for a toner capable of sufficiently fixing images with a low fixing energy, i.e., a so-called low temperature fixable toner. The toner capable of ensuring a good fixing property at a low temperature by using a low-molecular weight resin, etc., can achieve saving of energy. However, owing to heat or pressure generated when repeatedly subjected to a plurality of developing operations for along period of time, occurrence of spent toner on a surface of the carrier tends to be caused by continuous use thereof under high-temperature and high-humidity conditions, or there tends to arise such a problem that carrier particles are strongly adhered to each other while entangling a toner between spent portions thereof, so that the developer tends to suffer from occurrence of blocking, resulting in variation in electrification amount of the developer and therefore variation in image density and occurrence of fogging, etc.

In view of these problems, in order to inhibit occurrence of spent toner on a surface of the carrier, there has been conventionally proposed the method in which the surface of the carrier is coated with various resins. For example, it is known that the surface of the respective core material particles of the carrier is coated with a releasable resin such as a fluororesin and a silicone resin. Such a coated carrier not only can be controlled with various functions such as an electric charge amount and an electric resistance, but also hardly occur spent toner on the surface of the magnetic carrier because the surface thereof is coated with the low-surface energy substance. As a result, the carrier has a stable electric charge amount, and the developer using the carrier exhibits a long service life. However, the fluororesin and the silicone resin exhibit weak adhesion to the core material of the carrier, so that there tends to occur such a durability problem that a coating layer of these resins is peeled off from the carrier when repeatedly used.

Hitherto, as the carrier constituting a two-component system developer, there are well known an iron powder carrier, a ferrite carrier, a carrier of a binder type in which magnetic particles are dispersed in a binder resin, and a carrier of a coated type in which a magnetic material is coated with a resin.

The iron powder carrier and ferrite carrier are usually used in the form of resin-coated particles. However, since the iron powder carrier has a true specific gravity as large as 7 to 8 g/cm$^3$ and the ferrite carrier has a true specific gravity as large as 4.5 to 5.5 g/cm$^3$, a large driving force is required for stirring these carriers in the developing device, resulting in significant mechanical damage to the device, occurrence of spent toner as well as deterioration in charging property of the carrier itself and accelerated damage to the photosensitive member. Further, since the adhesion between the surface of the particles and the coating resin is not good, the coating resin tends to be gradually peeled off during use with the time, thereby causing variation in the charging property. As a result, the problems such as formation of images defect and beads carry over tend to be caused.

The carriers of a magnetic material-dispersed type comprising spherical composite particles formed from magnetic particles and a phenol resin as described in Japanese Patent Application Laid-Open (KOKAI) No. 2-220068 and Japanese Patent Application Laid-Open (KOKAI) No. 2000-199985 have a true specific gravity as small as 3 to 4 g/cm$^3$ as compared to the iron powder carrier or ferrite carrier, so that the energy upon impingement between the carrier and the toner becomes small. Therefore, it is advantageous to suppress occurrence of spent toner. Further, the carriers of the above type are far more excellent in adhesion to the coating resin, and therefore is almost free from such a problem that the coating resin is peeled-off during the use of the carrier.

With the recent progress of coloration of the toner, there is an increasing demand for carriers having a long service life for obtaining high-quality images. However, there tends to arise such a problem that the carriers are still insufficient to suppress occurrence of spent toner on a surface of the carrier particles, or peel-off or abrasion of the coating resin layer owing to impingement between the particles, mechanical agitation of the particles within a developing device and generation of heat caused thereby. Thus, it has been required that the carriers have a long service life capable of maintaining various properties such as a charging performance and an electric resistance over a long period of time.

Therefore, in order to further increase a service life of the magnetic carrier, it is strongly required to provide the magnetic carrier of a binder type which is capable of allowing a coating resin to strongly adhere onto the surface of the respective core material particles, is free from peeling or abrasion of the coating resin, and hardly suffers from occurrence of spent toner.

Conventionally, in order to enhance adhesion to a coating resin, there is described the magnetic carrier in which respective core material particles provided on a surface thereof with fine unevenness are coated with a resin (Patent Documents 1 to 3).

CITATION LIST

Patent Literatures

Patent Document 1: Japanese Patent Application Laid-Open (KOKAI) No. 3-229271

Patent Document 2: Japanese Patent Application Laid-Open (KOKAI) No. 8-44117

Patent Document 3: Japanese Patent Application Laid-Open (KOKAI) No. 2000-231224

SUMMARY OF THE INVENTION

Means for Solving the Problems

The respective techniques described in Patent Documents 1 to 3 have such a problem that adhesion of the coating resin to the surface of the respective core material particles is still insufficient.

In consequence, an object of the present invention is to provide a magnetic carrier for an electrophotographic developer in which by controlling surface properties of a core material for the magnetic carrier (spherical composite particles), a coating resin can be strongly adhered onto a surface of the respective spherical composite particle, and it is possible to suppress peeling of the coating resin layer, etc., and reduce occurrence of spent toner onto the magnetic carrier.

Means for Solving the Problems

The above object or technical task of the present invention can be achieved by the following Inventions.

That is, according to the present invention, there is provided a core material of a magnetic carrier for an electrophotographic developer comprising spherical composite particles comprising at least ferromagnetic iron oxide fine particles and a cured phenol resin and having an average particle diameter of 1 to 100 μm, a resin index of the spherical composite particles being within the range of 35 to 80% (Invention 1).

Also, according to the present invention, there is provided the core material of a magnetic carrier for an electrophotographic developer as described in the above Invention 1, wherein a contact angle of the spherical composite particles to water is within the range of 90 to 100° (Invention 2).

In addition, according to the present invention, there is provided a magnetic carrier for an electrophotographic developer comprising particles of the core material of a magnetic carrier for an electrophotographic developer as described in the above Invention 1 or 2, and a coating resin layer formed on a surface of the respective particles of the core material (Invention 3).

Also, according to the present invention, there is provided the magnetic carrier for an electrophotographic developer as described in the above Invention 3, wherein the coating resin is at least one resin selected from the group consisting of a silicone-based resin, an acrylic resin, a styrene-acrylic resin (Invention 4).

Further, according to the present invention, there is provided a two-component system developer comprising the magnetic carrier as described in the above Invention 3 or 4 and a toner (Invention 5).

Furthermore, according to the present invention, there is provided a process for producing the core material of a magnetic carrier for an electrophotographic developer as described in the above Invention 1 or 2, comprising the steps of:

reacting at least ferromagnetic iron oxide fine particles, a phenol compound and an aldehyde compound with each other in an aqueous medium in the presence of a basic catalyst to produce spherical composite particles comprising the ferromagnetic iron oxide fine particles and a cured phenol resin; and subjecting the thus produced spherical composite particles to heat treatment in a temperature range of 150 to 250° C. under a reduced pressure of 40 to 80 kPa in an inert atmosphere (Invention 6).

Effect of the Invention

The core material of a magnetic carrier for an electrophotographic developer according to the present invention which comprises spherical composite particles is well controlled in surface properties, so that a coating resin can be strongly adhered onto a surface of respective particles of the core material of the magnetic carrier, and the coating resin layer can be prevented from suffering from peeling therefrom. In addition, when using a resin-coated magnetic carrier as the magnetic carrier, occurrence of spent toner against the magnetic carrier can be decreased, so that the core material can be suitably used as a core material of a magnetic carrier for an electrophotographic developer.

In the process for producing the core material of a magnetic carrier according to the present invention, since the spherical composite particles can be well controlled in surface properties, a coating resin can be strongly adhered onto a surface of the respective spherical composite particles, and the coating resin layer can be prevented from suffering from peeling therefrom. Further, since a magnetic carrier for an electrophotographic developer which suffers from less occurrence of spent toner on the magnetic carrier can be obtained, the production process can be suitably used as a process for producing a core material of a magnetic carrier.

In the magnetic carrier according to the present invention, since the spherical composite particles used therein can be well controlled in surface properties, a coating resin can be strongly adhered onto a surface of the respective spherical composite particles, and the coating resin layer can be prevented from suffering from peeling therefrom. Further, since occurrence of spent toner on the magnetic carrier can be reduced, the magnetic carrier can be suitably used as a magnetic carrier for an electrophotographic developer.

The two-component system developer according to the present invention comprises the magnetic carrier having an excellent durability, and therefore can be suitably used as a developer adaptable to high image quality and high copying or printing speed.

PREFERRED EMBODIMENTS FOR CARRYING OUT THE INVENTION

The present invention is described in detail below.

First, the core material of a magnetic carrier for an electrophotographic developer according to the present invention (hereinafter referred to merely as a "magnetic carrier core material") is described.

The core material of a magnetic carrier for an electrophotographic developer according to the present invention comprises spherical composite particles comprising at least ferromagnetic iron oxide fine particles and a cured phenol resin and having an average particle diameter of 1 to 100 μm. The spherical composite particles have such a structure that the ferromagnetic iron oxide fine particles are dispersed in the phenol resin as a binder. In the present invention, in order to evaluate the coating condition of the phenol resin in the vicinity of the surface of the magnetic carrier core material, a "resin index" as described in Examples below is used. The term "resin index" used herein means an index relating to a proportion or thickness of the coating phenol resin in the vicinity of the surface of the magnetic carrier core material. By referring to the resin index, it is possible to evaluate a strength of an outermost surface of the magnetic carrier core material and an adhesion property of the magnetic carrier core material to a coating resin when a coating resin layer is formed on the respective core material particles.

The magnetic carrier core material according to the Invention 1 has a resin index of 35 to 80%, preferably 40 to 75% and more preferably 45 to 70%.

When the resin index of the magnetic carrier core material is less than 35%, the wettability of the coating resin to the magnetic carrier core material tends to be insufficient, or it may be difficult to uniformly coat the magnetic carrier core material with the coating resin because the coating resin tends to enter into recessed portions on the magnetic carrier core material, so that the resulting magnetic carrier tends to be impaired stable electric charge amount and electric resistance. In addition, the magnetic carrier core material tends to have a weak strength on an outermost surface thereof, so that the magnetic carrier tends to be insufficient to peeling of the coating layer therefrom upon stirring the developer. On the other hand, when the resin index of the magnetic carrier core material is more than 80%, the fine uneven structure on the respective particles of the magnetic carrier core material tends to be decreased, and it may be therefore difficult to attain a suitable anchor effect, so that the magnetic carrier tends to be insufficient to peeling of the coating layer therefrom upon stirring the developer. In addition, the magnetic carrier tends to exhibit a high electric resistance, so that it may be difficult to control the resistance by coating the magnetic carrier core material with the resin. In the present invention, by controlling the resin index of the magnetic carrier core material, it is possible to readily control the resistance by coating the magnetic carrier core material with the resin, or suppress deterioration of the magnetic carrier such as peeling of the coating layer, etc.

The contact angle of the magnetic carrier core material according to the present invention to water is preferably 90 to 100°, more preferably 90 to 99° and still more preferably 90 to 98°.

When the contact angle of the magnetic carrier core material according to the present invention to water is less than 90°, the wettability of the coating resin to the magnetic carrier core material tends to be deteriorated, and the magnetic carrier tends to be insufficient to peeling of the coating layer therefrom upon stirring the developer. On the other hand, when the contact angle of the magnetic carrier core material according to the present invention to water is more than 100°, the coating resin tends to be repelled by the magnetic carrier core material and agglomerated, so that it may be difficult to uniformly coat the magnetic carrier core material with the resin. When suitably controlling the contact angle of the magnetic carrier core material to water, it is possible to impart an adequate surface energy to the magnetic carrier core material, so that the coating resin can be strongly adhered onto the surface of the respective particles of the magnetic carrier core material, and peeling of the coating resin layer, etc., can be suppressed. In addition, it is possible to obtain a magnetic carrier capable of suppressing occurrence of spent toner on the magnetic carrier.

The magnetic carrier core material according to the present invention preferably has an average particle diameter of 1 to 100 μm. When the average particle diameter of the magnetic carrier core material is less than 1 μm, the magnetic carrier core material tends to suffer from secondary aggregation. When the average particle diameter of the magnetic carrier core material is more than 100 μm, the magnetic carrier core material tends to be deteriorated in mechanical strength, thereby failing to attain a clear image. The average particle diameter of the magnetic carrier core material is more preferably 10 to 70 μm.

The shape factors SF-1 and SF-2 of the of the magnetic carrier core material according to the present invention are preferably 100 to 120 and 100 to 120, respectively. The shape factor SF-1 is more preferably 100 to 110, and the shape factor SF-2 is more preferably 100 to 110.

The shape factor SF-1 indicates a degree of roundness of the particles, whereas the shape factor SF-2 indicates a degree of unevenness on the particles. Therefore, when the shape of the particles is deviated from a circle (sphere), the shape factor SF-1 becomes increased. Whereas, as the degree of unevenness on the surface of the respective particles is larger, the shape factor SF-2 becomes increased. When the shape of the particles approaches to a complete circle (sphere), the values of the respective shape factors become closer to 100.

When the shape of the magnetic carrier core material approaches to a complete sphere and the degree of unevenness on the surface thereof becomes small, the magnetic carrier obtained by coating the magnetic carrier core material with a resin provides a more uniform magnetic brush in a developing zone, so that beads carry over can be improved. On the other hand, when the shape factor SF-1 of the magnetic carrier core material is more than 120 or when the shape factor SF-2 of the magnetic carrier core material is more than 120, the magnetic carrier obtained by coating the magnetic carrier core material with a resin may fail to provide a uniform resin coating layer, so that the resulting carrier tends to exhibit uneven electric charge amount and resistance and therefore fail to obtain high-resolution images. In addition, the resin coating layer tends to be deteriorated in adhesion strength to the core material particles, so that the resulting carrier tends to be insufficient in durability.

The magnetic carrier core material according to the present invention preferably has a bulk density of not more than 2.5 g/cm$^3$ and more preferably 1.0 to 2.0 g/cm$^3$. The specific gravity of the magnetic carrier core material according to the present invention is preferably 2.5 to 4.5 and more preferably 3.0 to 4.0.

The magnetic carrier core material according to the present invention preferably has a saturation magnetization value of 40 to 80 Am$^2$/kg and more preferably 50 to 70 Am$^2$/kg, and a residual magnetization value of 1 to 20 Am$^2$/kg and more preferably 1 to 10 Am$^2$/kg.

The electric resistance value of the magnetic carrier core material according to the present invention is preferably $1.0\times10^5$ Ω·cm to $1.0\times10^{15}$ Ω·cm and more preferably $1.0\times10^6$ Ω·cm to $1.0\times10^{15}$ Ω·cm. When the electric resistance value of the magnetic carrier core material is less than $1\times10^5$ Ω·cm, there tends to undesirably arise such a problem that the magnetic carrier is attached onto an image forming portion of a photosensitive member owing to electric charge injected from a sleeve thereof, or a latent image charge is escaped through the magnetic carrier, resulting in occurrence of image defect and image deletion. On the other hand, when the electric resistance value of the magnetic carrier core material is more than $1.0\times10^{15}$ Ω·cm, the edge effect of solid images tends to occur, so that solid image portions tend to be hardly reproduced.

The water content of the magnetic carrier core material according to the present invention is preferably 0.1 to 0.8% by weight. When the water content of the magnetic carrier core material is less than 0.1% by weight, the resulting magnetic carrier tends to suffer from charge-up owing to lack of an adequate amount of water adsorbed thereinto so that the obtained images tend to be deteriorated. On the other hand, when the water content of the magnetic carrier core material is more than 0.8% by weight, the resulting magnetic carrier tends to become unstable in electric charge amount owing to variation of environmental conditions so that scattering of the toner tends to be caused. The water content of the magnetic carrier core material is more preferably 0.2 to 0.7% by weight.

The absorption index $K_D/C$ of the magnetic carrier core material according to the present invention as a ratio of a Henry's law constant $K_D$ for water adsorption to a whole carbon content C thereof is preferably 0.05 to 0.30 and more preferably 0.10 to 0.25.

The lower value of the Henry's law constant $K_D$ for water adsorption means that the magnetic carrier core material has such a structure that a less amount of water is adsorbed thereinto, and a less variation in amount of water adsorbed thereinto owing to variation of environmental conditions is caused. More specifically, when the absorption index $K_D/C$ of the magnetic carrier core material according to the present invention lies within the range of 0.05 to 0.30, the resulting magnetic carrier can maintain an adequate amount of water therein and undergo a less variation in amount of water adsorbed thereinto owing to variation of environmental conditions, and can retain a stable charge characteristic. That is, charge-up of the magnetic carrier and occurrence of fogging can be suppressed under low-humidity environmental conditions, and occurrence of fogging and scattering of the toner owing to deterioration in charge characteristic can be suppressed under high-humidity environmental conditions.

The content of the ferromagnetic iron oxide fine particles in the magnetic carrier core material according to the present invention is preferably 80 to 99% by weight based on the weight of the magnetic carrier core material. When the content of the ferromagnetic iron oxide fine particles in the magnetic carrier core material is less than 80% by weight, the resin content of the resulting magnetic carrier tends to be increased, so that coarse particles tends to be produced. When the content of the ferromagnetic iron oxide fine particles in the magnetic carrier core material is more than 99% by weight, the resin content of the resulting magnetic carrier tends to be deficient, so that the magnetic carrier may fail to have a sufficient strength. The content of the ferromagnetic iron oxide fine particles in the magnetic carrier core material is more preferably 85 to 99% by weight.

Next, the process for producing the core material of a magnetic carrier for an electrophotographic developer according to the present invention is described.

That is, the core material of a magnetic carrier for an electrophotographic developer according to the present invention may be produced by reacting a phenol compound and an aldehyde compound with each other in the coexistence of ferromagnetic iron oxide fine particles in the presence of a basic catalyst in an aqueous medium to thereby obtain spherical composite particles comprising the ferromagnetic iron oxide fine particles and a cured phenol resin.

Meanwhile, in the case where the spherical composite particles are produced by the above method, an alcohol compound may be used in the aqueous medium. The alcohol compound is added for the purpose of controlling a sphericity of the spherical composite particles.

Examples of the phenol compound used in the present invention include phenol; alkyl phenols such as m-cresol, p-cresol, p-tert-butyl phenol, o-propyl phenol, resorcinol and bisphenol A; and compounds having a phenolic hydroxyl group such as halogenated phenols obtained by replacing a part or whole of alkyl groups of the above alkyl phenols with a chlorine atom or a bromine atom. Among these phenol compounds, in view of a shaping property, most preferred is phenol.

In the present invention, phenol may be used in combination with at least one hydrophobic phenol compound. When a cresol compound such as m-cresol or p-cresol is incorporated as the hydrophobic phenol compound in the magnetic carrier core material, the contact angle of the magnetic carrier core material to water can be suitably controlled.

The cresol is preferably used in such an amount that the content of the cresol based on a total amount of phenol and cresol lies within the range of 0.01 to 5.0% by weight. The content of the cresol based on a total amount of phenol and cresol is more preferably 0.03 to 4.0% by weight, and still more preferably 0.05 to 3.0% by weight.

Examples of the aldehyde compound used in the present invention include formaldehyde which may be in the form of either formalin or para-aldehyde, acetaldehyde, furfural, glyoxal, acrolein, crotonaldehyde, salicylaldehyde and glutaraldehyde. Among these aldehyde compounds, most preferred is formaldehyde.

The molar ratio of the aldehyde compound to the phenol compound is preferably 1.0 to 4.0. When the molar ratio of the aldehyde compound to the phenol compound is less than 1.0, it may be difficult to produce the aimed particles, or since curing of the resin hardly proceeds, there is a tendency that the obtained particles have a low strength. When the molar ratio of the aldehyde compound to the phenol compound is more than 4.0, there is a tendency that the amount of the unreacted aldehyde compound remaining in the aqueous medium after the reaction is increased. The molar ratio of the aldehyde compound to the phenol compound is more preferably 1.2 to 3.0.

As the basic catalyst used in the present invention, there may be mentioned those basic catalysts ordinarily used for production of resol resins. Examples of the basic catalyst include aqueous ammonia, and alkyl amines such as hexamethylenetetramine, dimethyl amine, diethyl triamine and polyethylene imine. Among these basic catalysts, especially preferred is aqueous ammonia. The molar ratio of the basic catalyst to the phenol compound is preferably 0.05 to 1.50.

When the molar ratio of the basic catalyst to the phenol compound is less than 0.05, curing of the resin tends to hardly proceed sufficiently, so that it may be difficult to granulate the particles. When the molar ratio of the basic catalyst to the phenol compound is more than 1.50, the structure of the phenol resin tends to be adversely affected, resulting in deteriorated granulation of the particles, so that it may be difficult to obtain particles having a large particle diameter.

Examples of the ferromagnetic iron oxide fine particles used in the present invention include magnetoplumbite type iron oxide fine particles (such as strontium ferrite particles and barium ferrite particles), magnetite particle and the like. Among these ferromagnetic iron oxide fine particles, preferred are magnetite particles.

The average particle diameter of the ferromagnetic iron oxide fine particles is preferably 0.05 to 2.0 μm, and more preferably 0.08 to 1.0 μm. When the particle diameter of the ferromagnetic iron oxide fine particles is less than 0.05 μm, the ferromagnetic iron oxide fine particles tend to have a large cohesive force, so that it may be difficult to produce the spherical composite particles. On the other hand, when the particle diameter of the ferromagnetic iron oxide fine particles is more than 2.0 μm, the ferromagnetic iron oxide fine particles tend to be desorbed from the magnetic carrier.

The ferromagnetic iron oxide fine particles used in the present invention have a spherical shape, a plate shape, a hexahedral shape, an octahedral shape, a polyhedral shape and the like. Among these particle shapes, preferred is a spherical shape.

In the present invention, the ferromagnetic iron oxide fine particles may be used in combination with non-magnetic particles such as hematite.

In general, the ferromagnetic iron oxide fine particles may comprise a slight amount of impurities derived from the starting materials. Examples of the impurity components include $SiO_2$, Ca, Mn, Na, Mg, and anion components such as sulfate ions and chloride ions. These impurity components tend to impair an environmental stability of charge characteristics thereof. The ferromagnetic iron oxide fine particles preferably have such a high purity that the content of these impurities therein is not more than 2.0%.

The ferromagnetic iron oxide fine particles used in the present invention all are preferably previously subjected to lipophilic treatment. When using the ferromagnetic iron oxide fine particles not subjected to such a lipophilic treatment, it may be sometimes difficult to obtain composite particles having a spherical shape.

The lipophilic treatment may be suitably performed by the method of treating the ferromagnetic iron oxide fine particles with a coupling agent such as a silane coupling agent or a titanate coupling agent, or the method of dispersing the ferromagnetic iron oxide fine particles in an aqueous medium comprising a surfactant to allow the particles to adsorb the surfactant on a surface thereof.

Examples of the silane coupling agent include those having a hydrophobic group, an amino group or an epoxy group. Specific examples of the silane coupling agent having a hydrophobic group include vinyl trichlorosilane, vinyl triethoxysilane and vinyl-tris(β-methoxy) silane.

Examples of the silane coupling agent having an amino group include γ-aminopropyl triethoxysilane, N-β-(aminoethyl)-γ-aminopropyl trimethoxysilane, N-β-(aminoethyl)-γ-aminopropylmethyl dimethoxysilane and N-phenyl-γ-aminopropyl trimethoxysilane.

Examples of the silane coupling agent having an epoxy group include γ-glycidoxypropylmethyl diethoxysilane, γ-glycidoxypropyl trimethoxysilane and β-(3,4-epoxycyclohexyl)trimethoxysilane.

Examples of the titanate coupling agent include isopropyl triisostearoyl titanate, isopropyl tridecylbenzenesulfonyl titanate, isopropyl tris(dioctylpyrophosphate) titanate or the like.

As the surfactant, there may be used commercially available surfactants. Among these surfactants, those surfactants having a functional group capable of directly bonding to the surface of the ferromagnetic iron oxide fine particles or bonding to a hydroxyl group present on the surface of the ferromagnetic iron oxide fine particles are more suitably used, and the ionicity of the surfactants is preferably cationic or anionic.

Although the objects of the present invention can be achieved by using any of the above treatments, from the viewpoint of good adhesion to the phenol resin, the treatments with the silane coupling agent having an amino group or an epoxy group are preferred.

The treating amount of the above coupling agent or surfactant is preferably 0.1 to 10% by weight based on the weight of the ferromagnetic iron oxide fine particles to be treated.

The amount of the ferromagnetic iron oxide fine particles coexisting when the phenol compound and the aldehyde compound are reacted with each other in the presence of the basic catalyst is preferably 75 to 99% by weight based on the total amount of the ferromagnetic iron oxide fine particles, the phenol compound and the aldehyde compound. In view of the strength of the resulting magnetic carrier, the amount of the ferromagnetic iron oxide fine particles coexisting in the reaction is more preferably 78 to 99% by weight.

In the present invention, the reaction for production of the spherical composite particles may be carried out in the aqueous medium. The concentration of solid components in the aqueous medium is preferably controlled to 30 to 95% by weight and more preferably 60 to 90% by weight.

The reaction solution to which the basic catalyst is added is heated to the temperature range of 60 to 95° C., and reacted at that temperature for 30 to 300 min, preferably 60 to 240 min, to subject the resulting phenol resin to polycondensation reaction for curing thereof.

In the above reaction, in order to obtain spherical composite particles having a high sphericity, the reaction temperature is preferably gradually increased. The temperature rise rate is preferably 0.5 to 1.5° C./min and more preferably 0.8 to 1.2° C./min.

Also, in the above reaction, in order to well control the particle diameter of the obtained particles, the stirring speed of the reaction solution is suitably adjusted. The stirring speed is preferably 100 to 1000 rpm.

After completion of curing the resin, the reaction product is cooled to a temperature of not higher than 40° C., thereby obtaining a water dispersion of the spherical composite particles comprising the ferromagnetic iron oxide fine particles dispersed in the binder resin and exposed to the surface of the respective spherical composite particles.

The thus obtained water dispersion comprising the spherical composite particles is subjected to solid-liquid separation by ordinary methods such as filtration and centrifugal separation, and the obtained solids are washed, dried and then subjected to heat treatment, thereby obtaining the aimed magnetic carrier core material comprising the spherical composite particles.

The resin index of the magnetic carrier core material according to the present invention lies within the range of 35 to 80%. The method of controlling the resin index of the magnetic carrier core material to the above-specified range is as follows.

The magnetic carrier core material is preferably subjected to heat treatment in order to further cure the resin therein. In particular, the heat treatment is preferably carried out under reduced pressure or in an inert atmosphere to prevent oxidation of the ferromagnetic iron oxide fine particles. In the present invention, it has been found that the resin index of the magnetic carrier core material can be adjusted by subjecting the magnetic carrier core material to the heat treatment.

More specifically, the resin index of the magnetic carrier core material can be adjusted by controlling a degree of reduced pressure, a heat-treating temperature and a heat-treating time used in the heat treatment.

The spherical composite particles comprising magnetic particles and a phenol resin as described in Japanese Patent Application Laid-Open (KOKAI) No. 2-220068 and Japanese Patent Application Laid-Open (KOKAI) No. 2000-199985 are subjected to heat treatment under a very high degree of reduced pressure (665 Pa) and therefore are in the form of particles having a resin index of less than 35%. As a result, since the wettability of the coating resin to the magnetic carrier core material tends to be deteriorated, it may be difficult to uniformly coat the magnetic carrier core material with the resin, and the resulting magnetic carrier may fail to exhibit stable electric charge amount and electric resistance. Further, the outermost surface of the respective spherical composite particles tends to have a weak strength, so that the magnetic carrier tends to be insufficient to peeling of the coating layer therefrom upon stirring the developer. Therefore, there tends to arise such a problem that such a magnetic carrier is insufficient to the recent requirement for providing a longer-life carrier for obtaining high-quality images.

The magnetic carrier core material according to the present invention is subjected to heat treatment in a temperature range of 150 to 250° C. under a reduced pressure of 40 to 80 kPa in an inert atmosphere such as a nitrogen gas for 1 to 7 hr. With the heat treatment, it is possible to control the resin index of the magnetic carrier core material to the range of 35 to 80%.

When the magnetic carrier core material is heat-treated under a high degree of reduced pressure, i.e., under a pressure of less than 40 kPa, the amount of the resin present on the surface of the magnetic carrier core material tends to be considerably reduced, so that the wettability of the coating resin to the magnetic carrier core material tends to be deteriorated or the coating resin tends to enter into recessed portions on the magnetic carrier core material. As a result, it may be difficult to uniformly coat the magnetic carrier core material with the resin, and therefore the resulting magnetic carrier tends to be impaired stable electric charge amount and electric resistance. Further, the outermost surface of the magnetic carrier core material tends to have a weak strength, so that the obtained magnetic carrier tends to be insufficient to peeling of the coating layer therefrom upon stirring the developer. On the other hand, when the magnetic carrier core material is heat-treated under a low degree of reduced pressure, i.e., under pressure of more than 80 kPa, the fine unevenness formed on the surface of the respective magnetic carrier core material particles tends to become excessively small, so that the anchor effect on the surface of the respective particles tends to be hardly attained. Thus, the resulting magnetic carrier tends to be insufficient to peeling of the coating layer therefrom upon stirring the developer. In addition, the electric resistance of the magnetic carrier tends to be increased, so that it may be difficult to control the electric resistance by coating with the resin. Therefore, the reduced pressure upon subjecting the magnetic carrier core material to heat treatment is preferably 40 to 80 kPa, and more preferably 45 to 75 kPa.

When the magnetic carrier core material is subjected to heat treatment at a temperature higher than 250° C., the amount of the resin present on the surface of the magnetic carrier core material tends to be considerably reduced, so that the wettability of the coating resin to the magnetic carrier core material tends to be deteriorated or the coating resin tends to enter into recessed portions on the magnetic carrier core material. As a result, it may be difficult to uniformly coat the magnetic carrier core material with the resin, and therefore the resulting magnetic carrier tends to fail to exhibit stable electric charge amount and electric resistance. Further, the outermost surface of the magnetic carrier core material tends to have a weak strength, so that the obtained magnetic carrier tends to be insufficient to peeling of the coating layer therefrom upon stirring the developer. On the other hand, when the magnetic carrier core material is heat-treated at a temperature of lower than 150° C., the fine unevenness formed on the surface of the respective magnetic carrier core material particles tends to become excessively small owing to the presence of an excessive amount of the resin on the surface thereof, so that the anchor effect on the surface of the respective particles tends to be hardly attained. Thus, the resulting magnetic carrier tends to be insufficient to peeling of the coating layer therefrom upon stirring the developer. In addition, the electric resistance of the magnetic carrier tends to be increased, so that it may be difficult to control the electric resistance by coating with the resin. Therefore, the heat-treating temperature of the magnetic carrier core material is preferably 150 to 250° C., and more preferably 170 to 230° C.

When the magnetic carrier core material is subjected to heat treatment for a time period of more than 7 hr, the amount of the resin present on the surface of the magnetic carrier core material tends to be considerably reduced, so that the wettability of the coating resin to the magnetic carrier core material tends to be deteriorated or the coating resin tends to enter into recessed portions on the magnetic carrier core material. As a result, it may be difficult to uniformly coat the magnetic carrier core material with the resin, and therefore the resulting magnetic carrier tends to fail to exhibit stable electric charge amount and electric resistance. Further, the outermost surface of the magnetic carrier core material tends to have a weak strength, so that the obtained magnetic carrier tends to be insufficient to peeling of the coating layer therefrom upon stirring the developer. On the other hand, when the magnetic carrier core material is heat-treated for a time period of less than 1 hr, the fine unevenness formed on the surface of the respective magnetic carrier core material particles tends to become excessively small owing to the presence of an excessive amount of the resin on the surface thereof, so that the anchor effect on the surface of the respective particles tends to be hardly attained. Thus, the resulting magnetic carrier tends to be insufficient to peeling of the coating layer therefrom upon stirring the developer. In addition, the electric resistance of the magnetic carrier tends to be increased, so that it may be difficult to control the electric resistance by coating with the resin. Therefore, the heat-treating time of the magnetic carrier core material is preferably 1 to 7 hr, and more preferably 2 to 6 hr.

Meanwhile, the inert atmosphere is preferably produced by using an inert gas. Examples of the inert gas usable in the present invention include nitrogen, helium, argon and a carbon dioxide gas. From the industrial viewpoints, it is costly advantageous that the heat treatment is conducted while blowing a nitrogen gas, thereby obtaining products having stable characteristics.

Next, the magnetic carrier for an electrophotographic developer according to the present invention is described.

The magnetic carrier according to the present invention preferably has an average particle diameter of 1 to 100 μm, a bulk density of not more than 2.5 g/cm$^3$, a shape factor SF-1 of 100 to 120, a shape factor SF-2 of 100 to 120, a specific gravity of 2.5 to 4.5, a saturation magnetization value of 40 to 80 Am$^2$/kg, a residual magnetization value of 1 to 20 Am$^2$/kg, and a water content of 0.1 to 0.8% by weight.

The electric resistance value of the magnetic carrier according to the present invention is preferably $1.0\times10^6$ to $1.0\times10^{17}$ Ωcm, more preferably $1.0\times10^7$ to $1.0\times10^{17}$ Ωcm and still more preferably $1.0\times10^8$ to $1.0\times10^{17}$ Ωcm.

The magnetic carrier according to the present invention may also be formed by coating the surface of the magnetic carrier core material (spherical composite particles) with a resin.

The coating resin used in the present invention is not particularly limited. Examples of the coating resin include polyolefin-based resins such as polyethylene and polypropylene; polystyrene; acrylic resins; polyacrylonitrile; polyvinyl-based or polyvinylidene-based resins such as polyvinyl acetate, polyvinyl alcohol, polyvinyl butyral, polyvinyl chloride, polyvinyl carbazole, polyvinyl ether and polyvinyl ketone; vinyl chloride-vinyl acetate copolymers and styrene-acrylic acid copolymers; straight silicone-based resins having an organosiloxane bond and modified products thereof; fluorine-based resins such as polytetrafluoroethylene, polyvinyl fluoride, polyvinylidene fluoride and polychlorotrifluoroethylene; polyesters; polyurethanes; polycarbonates; amino-based resins such as urea-formaldehyde resins; epoxy-based resins; polyamide resins; polyimide resins; polyamide imide resins; fluorine-containing polyamide resins; fluorine-containing polyimide resins; and fluorine-containing polyamide imide resins.

In the magnetic carrier according to the present invention, the surface of the magnetic carrier core material is preferably coated with at least one resin selected from the group consisting of silicone-based resins, acrylic resins and styrene-acrylic resins. When coating the surface of the magnetic carrier core material particles with the silicone-based resins having a low surface energy, it is possible to suppress formation of spent toner. In addition, when coating the surface of the magnetic carrier core material with the acrylic resins or the styrene-acrylic resins, the effects of enhancing adhesion to the magnetic carrier core material as well as a charging property of the resulting magnetic carrier can be attained.

As the silicone-based resins, there may be used conventionally known silicone resins. Specific examples of the silicone-based resins include straight silicone resins comprising an organosiloxane bond only, and silicone resins obtained by modifying the straight silicone resins with an alkyd resin, a polyester resin, an epoxy resin, a urethane resin or the like.

Examples of the acrylic resins include copolymers obtained by copolymerizing an alkyl acrylate such as methyl methacrylate, methyl ethacrylate, ethyl methacrylate, butyl methacrylate, lauryl methacrylate, stearyl methacrylate and behenyl methacrylate, a cycloalkyl acrylate such as cyclopentyl methacrylate and cyclohexyl methacrylate, or an aromatic acrylate such as phenyl acrylate, with acrylic acid, copolymers obtained by copolymerizing the above acrylates with an epoxy compound such as glycidyl methacrylate, and copolymers obtained by copolymerizing the above acrylates with an alcohol-based compound such as glycerol monomethacrylate and 2-hydroxyethyl methacrylate. In view of less environmental dependency or the like of the resulting magnetic carrier, among these acrylic resins, preferred are those produced using short-chain alkyl acrylates such as methyl methacrylate and ethyl ethacrylate.

Examples of the styrene-acrylic resins include copolymers of the above acrylic monomers with styrene-based monomers. In view of a less difference in electric charge amount between under high-temperature and high-humidity conditions and under low-temperature and low-humidity conditions, preferred styrene-acrylic resins are copolymers of styrene with short-chain alkyl methacrylates.

The coating amount of the resin on the magnetic carrier of the present invention is preferably 0.1 to 5.0% by weight based on the weight of the magnetic carrier core material. When the coating amount of the resin is less than 0.1% by weight, it may be difficult to sufficiently coat the particles with the resin, resulting in unevenness of the obtained resin coat. When the coating amount of the resin is more than 5.0% by weight, although the resin coat can adhere onto the surface of the magnetic carrier core material particles, the thus produced magnetic carrier tend to be agglomerated together, so that it may be difficult to well control the particle size of the magnetic carrier. The coating amount of the resin on the magnetic carrier is more preferably 0.5 to 3.0% by weight.

In the present invention, the resin coating layer may also comprise fine particles. Examples of the suitable fine particles include those fine particles capable of imparting a negative charging property to a toner such as fine particles of quaternary ammonium salt-based compounds, triphenylmethane-based compounds, imidazole-based compounds, nigrosine-based dyes, polyamine resins, etc., and those fine particles capable of imparting a positive charging property to a toner such as fine particles of dyes comprising metals such as Cr and Co, salicylic acid metal salt compounds, alkyl salicylic acid metal salt compounds, etc. These fine particles may be used singly or in combination of any two or more thereof.

Also, in the present invention, the resin coating layer may also comprise conductive fine particles. It is advantageous to incorporate the conductive fine particles into the resin, because the resulting magnetic carrier can be readily controlled in electric resistance thereof. As the conductive fine particles, there may be used conventionally known fine particles. Examples of the conductive fine particles include fine particles of carbon blacks such as acetylene black, channel black, furnace black and Ketjen black; carbides of metals such as Si and Ti; nitrides of metals such as B and Ti; and borates of metals such as Mo and Cr. These conductive fine particles may be used singly or in combination of any two or more thereof. Among these conductive fine particles, preferred are fine particles of carbon blacks.

When coating the surface of the respective magnetic carrier core material particles with the resin, there may be used various known methods such as the method of spraying the resin onto the magnetic carrier core material using a spray dryer, the method of dry-mixing the magnetic carrier core material and the resin using a Henschel mixer, a high-speed mixer, etc., the method of immersing the magnetic carrier core material in a solvent comprising the resin, or the like.

Next, the two-component system developer of the present invention is described.

As the toner used in combination with the magnetic carrier according to the present invention, there may be mentioned any conventionally known toners. More specifically, there may be used those toners comprising a binder resin and a colorant as main components together with a release agent, a fluidizing agent, etc., which may be added to the main components, if required. Also, the toners may be produced by known methods.

<Function>

The important point of the present invention resides in that in the magnetic carrier core material comprising the spherical composite particles comprising at least the ferromagnetic iron oxide fine particles and the cured phenol resin which has an average particle diameter of 1 to 100 μm, the resin index of the spherical composite particles lies within the range of 35 to 80%.

In the present invention, by controlling surface properties of the spherical composite particles, it is possible to strongly bond the coating resin onto the surface of the respective spherical composite particles, suppress peeling of the coating resin layer therefrom, etc., and reduce occurrence of spent toner onto the magnetic carrier.

EXAMPLES

The present invention is described in more detail by the following typical Examples.

The resin index of the magnetic carrier core material (spherical composite particles) was evaluated by using the following apparatus and conditions. Using a scanning electron microscope "S-4800" manufactured by Hitachi Ltd., backscattered electron images of 10 or more spherical composite particles were observed at an acceleration voltage of 1 kV at a magnification of ×15000 times. The thus obtained backscattered electron image was binarized using an image processing software to distinguish an image portion of the ferromagnetic iron oxide fine particles from the other portion by contrast thereof. The portion other than the image portion of the ferromagnetic iron oxide fine particles was regarded as being a resin portion, and the ratio of an area of the resin portion to a whole area of the backscattered electron image of the composite particles was calculated from the following formula to determine a resin index (%) of the magnetic carrier core material. Meanwhile, as the image processing software, there may be used an ordinary software, and in the present invention, there was used "Image Analyzing Software A-zou-kun" manufactured by Asahi Kasei Engineering Corp.

Resin Index(%)=100−[(area of portion of ferromagnetic iron oxide fine particles)/(whole area of backscattered electron image of composite particles)×100]

The principle of the method for distinguishing the ferromagnetic iron oxide fine particles and the other components on the surface of the respective spherical composite particles is described below. First, by analyzing not secondary electrons generally used for observing a shape but backscattered electrons in a scanning electron microscope, it is possible to detect images owing to the difference in contrast between the ferromagnetic iron oxide fine particles and the other components by the atomic number effect of the backscattered electrons. The atomic number effect means such an effect that as the atomic number of a sample to be detected is increased, the amount of backscattered electrons discharged therefrom becomes larger, so that the sample is detected as a white contrast portion. As a result, the portion of the ferromagnetic iron oxide fine particles is observed as a white contrast portion, whereas the other portion is observed as a black contrast portion. Further, by adjusting the accelerated voltage to 1 kV, the depth of analysis of electron beams is rendered shallow so that it is possible to more accurately analyze the amount of the resin in the vicinity of the surface of the respective composite particles.

The contact angle of the spherical composite particles to water was measured at 25° C. using a wet tester "WTMY-232A Model" manufactured by Sankyo Pio-Tech Co., Ltd.

The spherical composite particles were charged into a powder measuring cell and tapped using "TAP-120" manufactured by Kuramochi Kagaku Kikai Seisakusho Co., Ltd., at a tapping speed of 120 strokes/min. The weight of the spherical composite particles was controlled such that the porosity of a powder layer thereof was within the range of 0.30 to 0.70. Meanwhile, the porosity of the powder layer was represented by the following formula.

$$\epsilon=1-m/(\rho\cdot L\cdot A)$$

wherein ρ: true density of composite particles (g/cm$^3$); L: height of powder layer (cm); A: area of cross section of cell (cm$^2$); m: weight of composite particles (g).

After tapped, the measuring cell was mounted to a measuring device to determine a capillary radius of the powder layer by an air permeability method, and then an threshold pressure was determined by a constant flow rate method.

The constant flow rate method is a method for measuring a negative capillary pressure caused when water is injecting into a powder layer of hydrophobic particles.

Specifically, in the case where the change in pressure is continuously measured while feeding water into the powder layer in the measuring cell at a constant flow rate, when water reaches a lower end of the powder layer of the hydrophobic particles, a negative capillary pressure acts on the water to drive the water out of the powder layer, so that the pressure is increased according to the Boyle's law. When water was further fed to the powder layer, penetration of water into the powder layer is initiated at the time at which the pressure exceeds the negative capillary pressure, and the change in pressure pattern occurs according to the Boyle's law. The point at which the pressure pattern is changed is regarded as an threshold pressure P. The contact angle of the composite particles to water is calculated from the threshold pressure P and a capillary radius r as a gap between the particles. Meanwhile, the contact angle is given by the following formula.

$$\cos\theta=-r\cdot g/(2\cdot\gamma)\times P$$

wherein θ: contact angle (°); r: capillary radius (cm); g: gravitational acceleration (980 cm/sec$^2$); γ: surface tension of water (dyn/cm); P: threshold pressure (g/cm$^2$).

The average particle diameter of the particles was expressed by the volume-based average particle diameter measured using a laser diffraction particle size distribution meter "LA750" manufactured by Horiba Seisakusho Co., Ltd. Also, the configuration of the particles was observed using a scanning electron microscope "S-4800" manufactured by Hitachi Ltd.

The shape factors SF-1 and SF-2 were measured by the following procedures.

The shape factors SF-1 and SF-2 were determined as follows. For example, 100 images of the particles were sampled at random from a enlarged micrograph (magnification: ×300 times) obtained by a scanning electron microscope ("S-4800" manufactured by Hitachi Ltd.), and the obtained image data was introduced through an interface, for example, into an image analyzer "Luzex AP" manufactured by Nireco Corp., to analyze the data. The shape factors SF-1 and SF-2 were defined by the values calculated based on the analyzed data from the following formulae.

SF-1=(absolute maximum length of particles)$^2$/(projected area of particles)×(π/4)×100

SF-2=(peripheral length of particles)$^2$/(projected area of particles)×(¼π)×100

The shape factor SF-1 indicates a degree of roundness of the particles, whereas the shape factor SF-2 indicates a degree of unevenness on the particles. Therefore, when the shape of the particles is deviated from a circle (sphere), the shape factor SF-1 becomes increased. Whereas, as the degree of unevenness on the surface of the respective particles is larger, the shape factor SF-2 becomes increased. When the shape of the particles approaches to a complete circle (sphere), the values of the respective shape factors become closer to 100.

The bulk density was measured according to the method described in JIS K5101.

The true specific gravity was expressed by the value measured using a multi-volume density meter "1305 Model" manufactured by Mictromeritics/Shimadzu Corp.

The saturation magnetization and residual magnetization of the particles were expressed by the values measured using a vibration sample magnetometer "VSM-3s-15" manufactured by Toei Kogyo Co., Ltd., by applying an external magnetic field of 79.58 kA/m (1 kOe) thereto.

The electric resistance value (volume resistivity) of the particles was expressed by the value measured using a "High Resistance Meter 4339B" manufactured by Yokogawa Hewlett Packard Co., Ltd., by applying a voltage of 100 V thereto.

The water content was measured by the following Karl Fischer coulometric titration method using a trace water content analyzer "AQ-2100" manufactured by Hiranuma Sangyo Co., Ltd. That is, 1 g of a sample whose moisture content was controlled by allowing the sample to stand under the environmental conditions of 24° C. and 60% RH for 24 hr or longer, was accurately weighed in a glass sampling tube, and then the sampling tube was closed with a lid through an aluminum foil (at this time, an empty sampling tube closed with a lid through an aluminum foil in the same manner was prepared in order to calibrate a water content in air).

Under the conditions including a heating temperature of 150° C. and a flow rate of a carrier gas (nitrogen gas) of 100 mL/min, water supplied from a water vaporization device "EV-2010" manufactured by Hiranuma Sangyo Co., Ltd., connected to the trace water content analyzer "AQ-2100", was subjected to titration under the conditions of INTERVAL=30 sec and TIMER=1 min. In the measurement, "HYDRANAL AQUALYTE RS" produced by Riedel de Haeen AG was used as a generating solution, and "AQUALYTE CN" produced by Kanto Kagaku Co., Ltd., was used as a counter electrode solution.

The whole carbon content C of the spherical composite particles was expressed by the value measured using a carbon/sulfur analyzer "EMIR-820W Model" manufactured by Horiba Seisakusho Co., Ltd. The calibration was conducted using a standard sample "JSS 102-8" prescribed by The Japan Iron and Steel Federation.

The Henry's law constant $K_D$ for water adsorption of the spherical composite particles was determined from a dual mode sorption model proposed by Barrer et al., and Michaels, et al.

That is, an adsorption C of an adsorbate to a polymer solid under a certain pressure is expressed by a sum of the amount $C_D$ according to the Henry's law and the amount $C_H$ according to the Langmuir's adsorption theory (expression 1; reference document: "Polymers and Water", The Society of Polymer Science, Japan, Kyoritu Publishing Co., Ltd.).

$$C=C_D+C_H=K_Dp+C_H'bp/(1+bp) \quad \text{<Expression 1>}$$

wherein $K_D$: Henry's law constant (mg/(g·kPa); $C_H'$: Langmuir volume constant (mg/g); b: Langmuir affinity constant (1/kPa); p: pressure (kPa).

Among the parameters in the above expression, the Henry's law constant $K_D$ is a parameter indicating a solubility i.e., permeability of the adsorbate into a solid; the Langmuir volume constant $C_H'$ is a parameter indicating a saturation adsorption of the adsorbate onto a surface of the solid in a monolayer adsorption; and the Langmuir affinity constant b is defined by a ratio between a condensation rate constant and an evaporation rate constant of the adsorbate on the surface of the solid and therefore is a parameter indicating an intensity of an interaction between the adsorbate and the solid.

The value of the Henry's law constant $K_D$ for water adsorption of the spherical composite particles can be measured using an apparatus capable of measuring a mass of the solid and a vapor pressure when a solid-vapor equilibrium is established under the condition in which only a vapor of an object to be measured (water in the case of the present invention) is present. As the above measuring apparatus, there may be mentioned, for example, an automatic vapor adsorption measuring apparatus "BELSORP-aqua3" manufactured by Bell Japan, Inc. In the below-mentioned Examples, the water adsorption of the spherical composite particles was measured at 25° C. using the above measuring apparatus, and the resulting adsorption isotherm was subjected to curve-fitting to the expression 1 to determine the value of the Henry's law constant $K_D$.

The electric charge amount of the toner was determined as follows. That is, 95 parts by weight of the magnetic carrier were fully mixed with 5 parts by weight of the toner produced by the following method, and the amount of electric charge generated on the toner was measured using a blow-off charge amount measuring device "TB-200" manufactured by Toshiba Chemical Corp.

(Toner Production Example 1)

| | |
|---|---|
| Polyester resin | 100 parts by weight |
| Copper phthalocyanine-based colorant | 5 parts by weight |
| Charge controlling agent (zinc di-tert-butyl salicylate compound) | 3 parts by weight |
| Wax | 9 parts by weight |

The above materials were fully premixed with each other using a Henschel mixer, and the resulting mixture was melted and kneaded in a twin-screw extrusion-type kneader.

After being cooled, the kneaded material was pulverized using a hammer mill and then classified to obtain negatively charging blue particles having a weight-average particle diameter of 7.4 μm.

On hundred parts by mass of the above negatively charging blue particles were mixed with 1 part by weight of a hydrophobic silica using a Henschel mixer to obtain a negatively charging cyan toner (a).

[Machine Evaluation of Magnetic Carrier]

The developer was prepared by intimately mixing 95 parts by weight of the magnetic carrier and 5 parts by weight of the negatively charging cyan toner (a).

The magnetic carrier was subjected to the following forced deterioration test in which 50 g of the magnetic carrier particles were charged into a 100-cc glass sampling bottle, and after the bottle was closed with a lid, the contents of the bottle were shaken using a paint conditioner manufactured by Red Devil Inc., for 48 hr. The magnetic carrier was evaluated based on the difference in properties between before and after the forced deterioration test.

Using the modified machine of a copying machine "LP8000C" manufactured by Epson Corp., while variously changing a bias voltage under the environmental conditions of 24° C. and 60% RH, 10,000 sheets were continuously copied from an original copy having an image ratio of 10%, and then the electric charge amounts and electric resistance values of the magnetic carrier before and after the copying operation were measured. Further, the surface of the respective magnetic carrier particles was observed using a scanning electron microscope "S-4800" manufactured by Hitachi Ltd., to confirm whether or not any peeling or abrasion of the resin coating layer occurred thereon.

The electric charge amount of the developer after the printing durability test was measured at normal temperature and normal humidity (24° C. and 60% RH). The electric charging characteristic of the magnetic carrier was expressed by a rate (%) of change in electric charge amount of the magnetic carrier of the following formula.

$$\text{Rate of change in charge amount}(\%)=(1-Q2/Q1)\times 100$$

Q1: Using the magnetic carrier before the forced deterioration test;

Q2: Using the magnetic carrier after the forced deterioration test;

The results were evaluated according to the following ratings. The Rank A, B or C is an acceptable level without practical problems.

A: Rate of change in charge amount of the magnetic carrier was not less than 0% and less than 5%;

B: Rate of change in charge amount of the magnetic carrier was not less than 5% and less than 10%;

C: Rate of change in charge amount of the magnetic carrier was not less than 10% and less than 20%;

D: Rate of change in charge amount of the magnetic carrier was not less than 20% and less than 30%; and E: Rate of change in charge amount of the magnetic carrier was not less than 30%.

The electric resistance value of the developer after the printing durability test was measured at normal temperature and normal humidity (24° C. and 60% RH). The resistance characteristic of the magnetic carrier was expressed by a rate (%) of change in electric resistance value of the magnetic carrier of the following formula.

$$\text{Rate of change in electric resistance}=\text{Log}(R1/R2)$$

R1: Using the magnetic carrier before the forced deterioration test;

R2: Using the magnetic carrier after the forced deterioration test;

The results were evaluated according to the following ratings. The Rank A, B or C is an acceptable level without practical problems.

A: Rate of change in electric resistance value of the magnetic carrier was not less than −0.5 and less than 0;

B: Rate of change in electric resistance value of the magnetic carrier was not less than 0 and less than 0.5;

C: Rate of change in electric resistance value of the magnetic carrier was not less than 0.5 and less than 1;

D: Rate of change in electric resistance value of the magnetic carrier was not less than 1 and less than 1.5; and E: Rate of change in electric resistance value of the magnetic carrier was not less than 1.5.

The peeling of the resin coating layer, etc, were evaluated using a scanning electron microscope "S-4800" manufactured by Hitachi Ltd., according to the following tree ratings. The Rank A or B is an acceptable level without practical problems.

A: Coating layer was free from peeling, abrasion, etc.

B: Coating layer slightly suffered from peeling, abrasion, etc.

C: Coating layer severely suffered from peeling, abrasion, etc.

<Lipophilic Treatment of Ferromagnetic Iron Oxide Fine Particles: Ferromagnetic Iron Oxide Fine Particles A)

One thousand grams of spherical magnetite particles (average particle diameter: 0.24 μm) were charged into a flask and fully stirred, and then 7.0 g of an epoxy group-containing silane-based coupling agent ("KBM-403" (tradename) produced by Shin-Etsu Chemical Corp.) were added to the flask. The contents of the flask were heated to about 100° C. and intimately mixed and stirred at that temperature for 30 min, thereby obtaining spherical magnetite particles coated with the silane-based coupling agent.

Example 1

[Production of Spherical Composite Particles]

| | |
|---|---|
| Phenol resin | 13 parts by weight |
| 37% Formalin | 15 parts by weight |
| Spherical magnetite particles A subjected to lipophilic treatment | 100 parts by weight |
| 25% Aqueous ammonia | 4 parts by weight |
| Water | 16 parts by weight |

The above materials were charged into a flask, and heated to 85° C. over 60 min while stirring at a stirring speed of 250 rpm, and then the contents of the flask were reacted and cured at the same temperature for 120 min, thereby producing composite particles comprising the ferromagnetic iron oxide fine particles and the binder resin.

Next, the contents of the flask were cooled to 30° C., and then a supernatant liquid was removed therefrom. Further, the resulting precipitate as a lower layer was washed with water and then air-dried. Next, the dried precipitate was subjected to heat treatment at 200° C. under a reduced pressure of 50 kPa in a nitrogen gas atmosphere for 4 hr to obtain spherical composite particles 1.

As a result, it was confirmed that the resulting spherical composite particles 1 had an average particle diameter of 36 μm; a bulk density of 1.94 g/cm$^3$, a specific gravity of 3.57 g/cm$^3$; a saturation magnetization value of 58.4 Am$^2$/kg, an electric resistance value of $9.2\times10^7$ Ω·cm, a resin index of 51%, and a contact angle to water of 94°.

Examples 2 and 3 and Comparative Examples 1 and 2

The same procedure as used for production of the spherical composite particles 1 was conducted except that the heat treatment conditions were changed variously, thereby obtaining spherical composite particles 2 to 5. The formulations and the like of the resulting spherical composite particles are shown in Table 1.

The properties of the resulting spherical composite particles 2 to 5 are shown in Table 2.

Comparative Example 3

| | |
|---|---|
| Phenol resin | 13 parts by weight |
| 37% Formalin | 17 parts by weight |
| Spherical magnetite particles A subjected to lipophilic treatment | 100 parts by weight |
| 25% Aqueous ammonia | 5 parts by weight |
| Water | 17 parts by weight |

The above materials were charged into a flask, and heated to 85° C. over 60 min while stirring at a stirring speed of 250 rpm, and then the contents of the flask were reacted and cured at the same temperature for 120 min, thereby producing composite particles comprising the ferromagnetic iron oxide fine particles and the binder resin.

Next, the contents of the flask were cooled to 30° C., and then a supernatant liquid was removed therefrom. Further, the resulting precipitate as a lower layer was washed with water and then air-dried. Next, the dried precipitate was subjected to heat treatment at 180° C. under a reduced pressure of 665 Pa for 2 hr to obtain spherical composite particles 6.

The properties of the resulting spherical composite particles 6 are shown in Table 2.

Examples 4 to 7 and Comparative Examples 4 and 5

The same procedure as used for production of the spherical composite particles 1 was conducted except that the amount of the binder resin, the amount of the aldehyde compound, the amount of the basic catalyst, the amount of water and the heat treatment conditions were changed variously, thereby obtaining spherical composite particles 7 to 12. The formulations and the like of the resulting spherical composite particles are shown in Table 1.

The properties of the resulting spherical composite particles 7 to 12 are shown in Table 2.

Comparative Example 6

| | |
|---|---|
| Phenol resin | 12 parts by weight |
| p-Cresol | 0.06 part by weight |
| 37% Formalin | 18 parts by weight |
| Spherical magnetite particles A subjected to lipophilic treatment | 100 parts by weight |
| 25% Aqueous ammonia | 6 parts by weight |
| Water | 19 parts by weight |

The above materials were charged into a flask, and heated to 85° C. over 60 min while stirring at a stirring speed of 250 rpm, and then the contents of the flask were reacted and cured at the same temperature for 120 min, thereby producing composite particles comprising the ferromagnetic iron oxide fine particles and the binder resin.

Next, the contents of the flask were cooled to 30° C., and then a supernatant liquid was removed therefrom. Further, the resulting precipitate as a lower layer was washed with water and then air-dried. Next, the dried precipitate was subjected to heat treatment at 260° C. under a reduced pressure of 60 kPa in a nitrogen atmosphere for 5.5 hr to obtain spherical composite particles 13.

The properties of the resulting spherical composite particles 13 are shown in Table 2.

Comparative Example 7

The same procedure as used for production of the spherical composite particles 13 was conducted except that the amount of the binder resin was changed, thereby obtaining spherical composite particles 14. The formulations and the like of the resulting spherical composite particles are shown in Table 1.

The properties of the resulting spherical composite particles 14 are shown in Table 2.

Examples 8 to 10

The same procedure as used for production of the spherical composite particles 1 was conducted except that the amount of the binder resin, the amount of the aldehyde compound, the amount of the basic catalyst, the amount of water and the heat treatment conditions were changed variously, thereby obtaining spherical composite particles 15 to 17. The formulations and the like of the resulting spherical composite particles are shown in Table 1.

The properties of the resulting spherical composite particles 15 to 17 are shown in Table 2.

Example 11

| | |
|---|---|
| Phenol resin | 14 parts by weight |
| m-Cresol | 0.07 part by weight |
| 37% Formalin | 17 parts by weight |
| Spherical magnetite particles A subjected to lipophilic treatment | 100 parts by weight |
| 25% Aqueous ammonia | 6 parts by weight |
| Water | 19 parts by weight |

The above materials were charged into a flask, and heated to 85° C. over 60 min while stirring at a stirring speed of 250 rpm, and then the contents of the flask were reacted and cured at the same temperature for 120 min, thereby producing composite particles comprising the ferromagnetic iron oxide fine particles and the binder resin.

Next, the contents of the flask were cooled to 30° C., and then a supernatant liquid was removed therefrom. Further, the resulting precipitate as a lower layer was washed with water and then air-dried. Next, the dried precipitate was subjected to heat treatment at 250° C. under a reduced pressure of 50 kPa in a nitrogen atmosphere for 2.5 hr to obtain spherical composite particles 18.

The properties of the resulting spherical composite particles 18 are shown in Table 2.

Example 12

The same procedure as used for production of the spherical composite particles 18 was conducted except that the amount of the binder resin was changed, thereby obtaining spherical composite particles 19. The formulations and the like of the resulting spherical composite particles are shown in Table 1.

The properties of the resulting spherical composite particles 19 are shown in Table 2.

Example 13

The same procedure as used for production of the spherical composite particles 1 was conducted except that the amount of the binder resin, the amount of the aldehyde compound, the amount of the basic catalyst, the amount of water and the heat treatment conditions were changed, thereby obtaining spherical composite particles 20. The formulations and the like of the resulting spherical composite particles are shown in Table 1.

The properties of the resulting spherical composite particles 20 are shown in Table 2.

Example 14

The same procedure as used for production of the spherical composite particles 13 was conducted except that the amount of the binder resin, the amount of the aldehyde compound, the amount of the basic catalyst, the amount of water and the heat treatment conditions were changed, thereby obtaining spherical composite particles 21. The formulations and the like of the resulting spherical composite particles are shown in Table 1.

The properties of the resulting spherical composite particles 21 are shown in Table 2.

TABLE 1

| Examples and Comparative Examples | Composite particles | Composite particles Ferromagnetic iron oxide particles | |
|---|---|---|---|
| | | Kind | Weight part(s) |
| Example 1 | 1 | A | 100 |
| Example 2 | 2 | A | 100 |
| Example 3 | 3 | A | 100 |
| Comparative Example 1 | 4 | A | 100 |
| Comparative Example 2 | 5 | A | 100 |
| Comparative Example 3 | 6 | A | 100 |
| Example 4 | 7 | A | 100 |
| Example 5 | 8 | A | 100 |
| Example 6 | 9 | A | 100 |
| Example 7 | 10 | A | 100 |
| Comparative Example 4 | 11 | A | 100 |
| Comparative Example 5 | 12 | A | 100 |
| Comparative Example 6 | 13 | A | 100 |
| Comparative Example 7 | 14 | A | 100 |
| Example 8 | 15 | A | 100 |
| Example 9 | 16 | A | 100 |
| Example 10 | 17 | A | 100 |
| Example 11 | 18 | A | 100 |
| Example 12 | 19 | A | 100 |
| Example 13 | 20 | A | 100 |
| Example 14 | 21 | A | 100 |

| Examples and Comparative Examples | Composite particles Binder resin | | |
|---|---|---|---|
| | Phenol | Compound 1 | |
| | Weight part(s) | Kind | Weight part(s) |
| Example 1 | 13 | | |
| Example 2 | 13 | | |
| Example 3 | 13 | | |
| Comparative Example 1 | 13 | | |
| Comparative Example 2 | 13 | | |
| Comparative Example 3 | 13 | | |
| Example 4 | 12 | | |
| Example 5 | 12 | | |
| Example 6 | 12 | | |
| Example 7 | 12 | | |
| Comparative Example 4 | 12 | | |
| Comparative Example 5 | 12 | | |
| Comparative Example 6 | 12 | p-Cresol | 0.06 |
| Comparative Example 7 | 12 | p-Cresol | 0.12 |
| Example 8 | 12 | | |
| Example 9 | 12 | | |
| Example 10 | 14 | | |
| Example 11 | 14 | m-Cresol | 0.07 |
| Example 12 | 14 | m-Cresol | 0.14 |
| Example 13 | 13 | | |
| Example 14 | 13 | p-Cresol | 0.13 |

| Examples and Comparative Examples | Composite particles | | | |
|---|---|---|---|---|
| | Aldehyde compound | | Basic catalyst | |
| | Kind | Weight part(s) | Kind | Weight part(s) |
| Example 1 | 37% formalin | 15 | 25% ammonia water | 4 |
| Example 2 | 37% formalin | 15 | 25% ammonia water | 4 |
| Example 3 | 37% formalin | 15 | 25% ammonia water | 4 |
| Comparative Example 1 | 37% formalin | 15 | 25% ammonia water | 4 |
| Comparative Example 2 | 37% formalin | 15 | 25% ammonia water | 4 |
| Comparative Example 3 | 37% formalin | 17 | 25% ammonia water | 5 |
| Example 4 | 37% formalin | 18 | 25% ammonia water | 6 |
| Example 5 | 37% formalin | 18 | 25% ammonia water | 6 |
| Example 6 | 37% formalin | 18 | 25% ammonia water | 6 |
| Example 7 | 37% formalin | 18 | 25% ammonia water | 6 |
| Comparative Example 4 | 37% formalin | 18 | 25% ammonia water | 6 |
| Comparative Example 5 | 37% formalin | 18 | 25% ammonia water | 6 |
| Comparative Example 6 | 37% formalin | 18 | 25% ammonia water | 6 |
| Comparative Example 7 | 37% formalin | 18 | 25% ammonia water | 6 |
| Example 8 | 37% formalin | 16 | 25% ammonia water | 5 |
| Example 9 | 37% formalin | 16 | 25% ammonia water | 5 |
| Example 10 | 37% formalin | 17 | 25% ammonia water | 6 |
| Example 11 | 37% formalin | 17 | 25% ammonia water | 6 |
| Example 12 | 37% formalin | 17 | 25% ammonia water | 6 |
| Example 13 | 37% formalin | 15 | 25% ammonia water | 4 |
| Example 14 | 37% formalin | 15 | 25% ammonia water | 4 |

TABLE 1-continued

| Examples and Comparative Examples | Composite particles Water Weight part(s) | Heat treatment Reduced pressure kPa | Temp. ° C. | Treating time hr |
|---|---|---|---|---|
| Example 1 | 16 | 50 | 200 | 4 |
| Example 2 | 16 | 60 | 200 | 4 |
| Example 3 | 16 | 70 | 200 | 4 |
| Comparative Example 1 | 16 | 85 | 200 | 4 |
| Comparative Example 2 | 16 | 30 | 200 | 4 |
| Comparative Example 3 | 17 | 0.67 | 180 | 2 |
| Example 4 | 19 | 60 | 170 | 5.5 |
| Example 5 | 19 | 60 | 200 | 5.5 |
| Example 6 | 19 | 60 | 230 | 5.5 |
| Example 7 | 19 | 60 | 150 | 5.5 |
| Comparative Example 4 | 19 | 60 | 140 | 5.5 |
| Comparative Example 5 | 19 | 60 | 260 | 5.5 |
| Comparative Example 6 | 19 | 60 | 260 | 5.5 |
| Comparative Example 7 | 19 | 60 | 260 | 5.5 |
| Example 8 | 18 | 40 | 155 | 5 |
| Example 9 | 18 | 70 | 240 | 3 |
| Example 10 | 19 | 50 | 250 | 2.5 |
| Example 11 | 19 | 50 | 250 | 2.5 |
| Example 12 | 19 | 50 | 250 | 2.5 |
| Example 13 | 16 | 77 | 150 | 4 |
| Example 14 | 16 | 77 | 150 | 4 |

TABLE 2

| Examples and Comparative Examples | Composite particles | Properties of composite particles: Average particle diameter (μm) | Shape factor SF-1 | Shape factor SF-2 |
|---|---|---|---|---|
| Example 1 | 1 | 36 | 103 | 102 |
| Example 2 | 2 | 36 | 103 | 104 |
| Example 3 | 3 | 36 | 104 | 104 |
| Comparative Example 1 | 4 | 36 | 103 | 104 |
| Comparative Example 2 | 5 | 37 | 103 | 104 |
| Comparative Example 3 | 6 | 37 | 103 | 104 |
| Example 4 | 7 | 37 | 104 | 104 |
| Example 5 | 8 | 37 | 105 | 104 |
| Example 6 | 9 | 38 | 103 | 102 |
| Example 7 | 10 | 37 | 103 | 104 |
| Comparative Example 4 | 11 | 37 | 104 | 104 |
| Comparative Example 5 | 12 | 38 | 104 | 103 |
| Comparative Example 6 | 13 | 38 | 103 | 102 |
| Comparative Example 7 | 14 | 39 | 103 | 103 |
| Example 8 | 15 | 44 | 105 | 104 |
| Example 9 | 16 | 43 | 104 | 103 |
| Example 10 | 17 | 32 | 103 | 104 |
| Example 11 | 18 | 32 | 103 | 105 |
| Example 12 | 19 | 34 | 103 | 104 |
| Example 13 | 20 | 36 | 103 | 104 |
| Example 14 | 21 | 36 | 104 | 104 |

TABLE 2-continued

| Examples and Comparative Examples | Properties of composite particles: Bulk density ($g/cm^3$) | Specific gravity ($g/cm^3$) | Saturation magnetization ($Am^2/kg$) |
|---|---|---|---|
| Example 1 | 1.94 | 3.57 | 58.4 |
| Example 2 | 1.94 | 3.56 | 57.4 |
| Example 3 | 1.95 | 3.57 | 57.4 |
| Comparative Example 1 | 1.94 | 3.55 | 57.4 |
| Comparative Example 2 | 1.94 | 3.57 | 57.4 |
| Comparative Example 3 | 1.94 | 3.57 | 59.0 |
| Example 4 | 1.89 | 3.58 | 57.8 |
| Example 5 | 1.89 | 3.58 | 57.4 |
| Example 6 | 1.90 | 3.57 | 61.1 |
| Example 7 | 1.92 | 3.58 | 58.0 |
| Comparative Example 4 | 1.90 | 3.58 | 58.6 |
| Comparative Example 5 | 1.89 | 3.58 | 57.5 |
| Comparative Example 6 | 1.85 | 3.62 | 59.2 |
| Comparative Example 7 | 1.86 | 3.64 | 59.0 |
| Example 8 | 1.92 | 3.55 | 58.4 |
| Example 9 | 1.90 | 3.57 | 58.3 |
| Example 10 | 1.90 | 3.59 | 58.9 |
| Example 11 | 1.89 | 3.60 | 59.3 |
| Example 12 | 1.86 | 3.60 | 59.1 |
| Example 13 | 1.94 | 3.56 | 57.8 |
| Example 14 | 1.91 | 3.53 | 58.0 |

| Examples and Comparative Examples | Properties of composite particles: Residual magnetization ($Am^2/kg$) | Electric resistance ($\Omega \cdot cm$) | Content of magnetic particles (%) |
|---|---|---|---|
| Example 1 | 5.1 | 9.2E+07 | 86 |
| Example 2 | 5.1 | 6.2E+08 | 86 |
| Example 3 | 5.1 | 4.5E+08 | 86 |
| Comparative Example 1 | 5.1 | 1.9E+08 | 86 |
| Comparative Example 2 | 5.0 | 2.0E+08 | 86 |
| Comparative Example 3 | 5.2 | 8.5E+07 | 86 |
| Example 4 | 4.9 | 3.5E+08 | 86 |
| Example 5 | 5.1 | 1.7E+08 | 86 |
| Example 6 | 5.2 | 4.0E+08 | 86 |
| Example 7 | 5.0 | 1.7E+08 | 86 |
| Comparative Example 4 | 5.1 | 2.2E+08 | 86 |
| Comparative Example 5 | 4.6 | 9.0E+07 | 86 |
| Comparative Example 6 | 4.8 | 8.7E+07 | 87 |
| Comparative Example 7 | 4.9 | 2.7E+08 | 87 |
| Example 8 | 5.0 | 2.0E+08 | 86 |
| Example 9 | 5.0 | 2.3E+08 | 86 |
| Example 10 | 5.0 | 7.2E+07 | 87 |
| Example 11 | 4.9 | 3.0E+08 | 87 |
| Example 12 | 4.9 | 2.5E+08 | 87 |
| Example 13 | 5.0 | 2.6E+08 | 86 |
| Example 14 | 5.0 | 3.2E+08 | 86 |

| Examples and Comparative Examples | Properties of composite particles: Resin index (%) | Contact angle (°) | $K_D/C$ |
|---|---|---|---|
| Example 1 | 51 | 94 | 0.16 |
| Example 2 | 59 | 95 | 0.22 |
| Example 3 | 65 | 98 | 0.20 |

TABLE 2-continued

| | | | |
|---|---|---|---|
| Comparative Example 1 | 84 | 104 | 0.18 |
| Comparative Example 2 | 29 | * | 0.15 |
| Comparative Example 3 | 32 | 91 | 0.16 |
| Example 4 | 64 | 98 | 0.23 |
| Example 5 | 57 | 96 | 0.21 |
| Example 6 | 53 | 93 | 0.18 |
| Example 7 | 76 | 98 | 0.18 |
| Comparative Example 4 | 81 | 102 | 0.17 |
| Comparative Example 5 | 30 | * | 0.19 |
| Comparative Example 6 | 30 | 90 | 0.20 |
| Comparative Example 7 | 29 | 91 | 0.20 |
| Example 8 | 64 | 95 | 0.19 |
| Example 9 | 53 | 95 | 0.17 |
| Example 10 | 36 | 90 | 0.18 |
| Example 11 | 37 | 91 | 0.18 |
| Example 12 | 38 | 91 | 0.19 |
| Example 13 | 79 | 100 | 0.19 |
| Example 14 | 78 | 102 | 0.18 |

Note
* Not measurable because of hydrophilicity

Meanwhile, with respect to the magnetic carrier core materials obtained in Comparative Examples 2 and 5, it was not possible to measure a contact angle of these materials owing to hydrophilicity thereof.

Example 15

[Production Example of Magnetic Carrier]

Under a nitrogen flow, a Henschel mixer was charged with 1 kg of the spherical composite particles 1, 10 g (as a solid content) of a silicone-based resin (tradename "KR251" produced by Shin-Etsu Chemical Co., Ltd.) and 1.5 g of carbon black (tradename "TOKABLACK #4400" produced by Tokai Carbon Co., Ltd.), and the contents of the Henschel mixer were stirred at a temperature of 50 to 150° C. for 1 hr, thereby forming a resin coating layer formed of the silicone-based resin comprising carbon black on the surface of the respective particles.

The thus obtained resin-coated carrier 1 had an average particle diameter of 36 μm, a bulk density of 1.86 g/cm$^3$, a specific gravity of 3.55 g/cm$^3$, a saturation magnetization value of 58.3 Am$^2$/kg, and an electric resistance value of $7.9\times10^{10}$ Ω·cm.

Examples 16 and 17, Examples 26 and 27, Comparative Examples 8 to 10, and Comparative Examples 11 to 14

The same procedure as in Example 15 was conducted except that the kind of spherical composite particles were changed variously, thereby obtaining resin-coated carriers.

The production conditions and various properties of the resin-coated carriers obtained in Examples 16 and 17, Examples 26 and 27, Comparative Examples 8 to 10, and Comparative Examples 11 to 14 are shown in Table 3.

Example 18

Under a nitrogen flow, a Henschel mixer was charged with 1 kg of the spherical composite particles 7, 10 g (as a solid content) of an acrylic resin (tradename "BR80" produced by Mitsubishi Rayon Co., Ltd.) and 1.5 g of carbon black (tradename "TOKABLACK #4400" produced by Tokai Carbon Co., Ltd.), and the contents of the Henschel mixer were stirred at a temperature of 50 to 150° C. for 1 hr, thereby forming a resin coating layer formed of the acrylic resin comprising carbon black on the surface of the respective particles.

The thus obtained resin-coated carrier 7 had an average particle diameter of 38 μm, a bulk density of 1.79 g/cm$^3$, a specific gravity of 3.52 g/cm$^3$, a saturation magnetization value of 56.0 Am$^2$/kg, and an electric resistance value of $1.0\times10^{12}$ Ω·cm.

Examples 19 to 21, Examples 28 to 30, and Comparative Examples 15 and 16

The same procedure as in Example 18 was conducted except that the kind of spherical composite particles were changed variously, thereby obtaining resin-coated carriers.

The production conditions and various properties of the resin-coated carriers obtained in Examples 19 to 21, Examples 28 to 30, and Comparative Examples 15 and 16 are shown in Table 3.

Example 22

Under a nitrogen flow, a Henschel mixer was charged with 1 kg of the spherical composite particles 7, 10 g (as a solid content) of a styrene-methyl methacrylate copolymer (tradename "BR50" produced by Mitsubishi Rayon Co., Ltd.) and 1.5 g of carbon black (tradename "TOKABLACK #4400" produced by Tokai Carbon Co., Ltd.), and the contents of the Henschel mixer were stirred at a temperature of 50 to 150° C. for 1 hr, thereby forming a resin coating layer formed of the styrene-methyl methacrylate copolymer resin comprising carbon black on the surface of the respective particles.

The thus obtained resin-coated carrier 11 had an average particle diameter of 39 μm, a bulk density of 1.82 g/cm$^3$, a specific gravity of 3.55 g/cm$^3$, a saturation magnetization value of 56.5 Am$^2$/kg, and an electric resistance value of $9.2\times10^{11}$ Ω·cm.

Examples 23 to 25, and Examples 31 and 32

The same procedure as in Example 22 was conducted except that the kind of spherical composite particles were changed variously, thereby obtaining resin-coated carriers.

The production conditions and various properties of the resin-coated carriers obtained in Examples 23 to 25, and Examples 31 and 32 are shown in Table 3.

The results of machine evaluation of the resin-coated magnetic carriers obtained in Examples 15 to 32 and Comparative Examples 8 to 16 are shown in Table 3.

TABLE 3

| Examples and Comparative Examples | Composite particles | Magnetic carrier | Composition of magnetic carrier Coating resin Kind | Ratio to core (%) |
|---|---|---|---|---|
| Example 15 | 1 | 1 | *1 | 1.0 |
| Example 16 | 2 | 2 | *1 | 1.0 |
| Example 17 | 3 | 3 | *1 | 1.0 |
| Comparative Example 8 | 4 | 4 | *1 | 1.0 |

TABLE 3-continued

| | | | | |
|---|---|---|---|---|
| Comparative Example 9 | 6 | 5 | *1 | 1.0 |
| Comparative Example 10 | 5 | 6 | *1 | 1.0 |
| Example 18 | 7 | 7 | *2 | 1.0 |
| Example 19 | 8 | 8 | *2 | 1.0 |
| Example 20 | 9 | 9 | *2 | 1.0 |
| Example 21 | 10 | 10 | *2 | 1.0 |
| Example 22 | 7 | 11 | *3 | 1.0 |
| Example 23 | 8 | 12 | *3 | 1.0 |
| Example 24 | 9 | 13 | *3 | 1.0 |
| Example 25 | 10 | 14 | *3 | 1.0 |
| Comparative Example 11 | 11 | 15 | *1 | 1.0 |
| Comparative Example 12 | 12 | 16 | *1 | 1.0 |
| Comparative Example 13 | 13 | 17 | *1 | 1.0 |
| Comparative Example 14 | 14 | 18 | *1 | 1.0 |
| Comparative Example 15 | 11 | 19 | *2 | 1.0 |
| Comparative Example 16 | 12 | 20 | *2 | 1.0 |
| Example 26 | 15 | 21 | *1 | 1.0 |
| Example 27 | 16 | 22 | *1 | 1.0 |
| Example 28 | 17 | 23 | *2 | 1.0 |
| Example 29 | 18 | 24 | *2 | 1.0 |
| Example 30 | 19 | 25 | *2 | 1.0 |
| Example 31 | 20 | 26 | *3 | 1.0 |
| Example 32 | 21 | 27 | *3 | 1.0 |

| Examples and Comparative Examples | Composition of magnetic carrier Additives | |
|---|---|---|
| | Kind | Ratio to resin (%) |
| Example 15 | Carbon black | 15 |
| Example 16 | Carbon black | 15 |
| Example 17 | Carbon black | 15 |
| Comparative Example 8 | Carbon black | 15 |
| Comparative Example 9 | Carbon black | 15 |
| Comparative Example 10 | Carbon black | 15 |
| Example 18 | Carbon black | 15 |
| Example 19 | Carbon black | 15 |
| Example 20 | Carbon black | 15 |
| Example 21 | Carbon black | 15 |
| Example 22 | Carbon black | 15 |
| Example 23 | Carbon black | 15 |
| Example 24 | Carbon black | 15 |
| Example 25 | Carbon black | 15 |
| Comparative Example 11 | Carbon black | 15 |
| Comparative Example 12 | Carbon black | 15 |
| Comparative Example 13 | Carbon black | 15 |
| Comparative Example 14 | Carbon black | 15 |
| Comparative Example 15 | Carbon black | 15 |
| Comparative Example 16 | Carbon black | 15 |
| Example 26 | Carbon black | 15 |
| Example 27 | Carbon black | 15 |
| Example 28 | Carbon black | 15 |
| Example 29 | Carbon black | 15 |
| Example 30 | Carbon black | 15 |
| Example 31 | Carbon black | 15 |
| Example 32 | Carbon black | 15 |

TABLE 3-continued

| Examples and Comparative Examples | Properties of magnetic carrier | | |
|---|---|---|---|
| | Average particle diameter (μm) | Shape factor | |
| | | SF-1 | SF-2 |
| Example 15 | 36 | 102 | 103 |
| Example 16 | 36 | 102 | 102 |
| Example 17 | 37 | 104 | 103 |
| Comparative Example 8 | 37 | 103 | 103 |
| Comparative Example 9 | 36 | 102 | 103 |
| Comparative Example 10 | 38 | 105 | 105 |
| Example 18 | 38 | 103 | 103 |
| Example 19 | 38 | 103 | 104 |
| Example 20 | 38 | 104 | 103 |
| Example 21 | 38 | 102 | 103 |
| Example 22 | 39 | 103 | 103 |
| Example 23 | 38 | 104 | 105 |
| Example 24 | 38 | 103 | 103 |
| Example 25 | 39 | 103 | 103 |
| Comparative Example 11 | 39 | 105 | 105 |
| Comparative Example 12 | 38 | 104 | 104 |
| Comparative Example 13 | 39 | 104 | 102 |
| Comparative Example 14 | 39 | 103 | 102 |
| Comparative Example 15 | 38 | 103 | 105 |
| Comparative Example 16 | 38 | 104 | 104 |
| Example 26 | 44 | 104 | 104 |
| Example 27 | 45 | 105 | 104 |
| Example 28 | 32 | 104 | 103 |
| Example 29 | 33 | 103 | 104 |
| Example 30 | 33 | 104 | 103 |
| Example 31 | 37 | 103 | 103 |
| Example 32 | 38 | 103 | 104 |

| Examples and Comparative Examples | Properties of magnetic carrier | | |
|---|---|---|---|
| | Bulk density ($g/cm^3$) | Specific gravity ($g/cm^3$) | Saturation magnetization ($Am^2/kg$) |
| Example 15 | 1.86 | 3.55 | 58.3 |
| Example 16 | 1.84 | 3.52 | 57.1 |
| Example 17 | 1.85 | 3.53 | 57.4 |
| Comparative Example 8 | 1.86 | 3.53 | 57.1 |
| Comparative Example 9 | 1.87 | 3.50 | 58.5 |
| Comparative Example 10 | 1.86 | 3.50 | 57.3 |
| Example 18 | 1.79 | 3.52 | 56.0 |
| Example 19 | 1.80 | 3.53 | 56.7 |
| Example 20 | 1.85 | 3.53 | 60.9 |
| Example 21 | 1.86 | 3.51 | 57.8 |
| Example 22 | 1.82 | 3.55 | 56.5 |
| Example 23 | 1.81 | 3.56 | 56.9 |
| Example 24 | 1.83 | 3.51 | 60.8 |
| Example 25 | 1.82 | 3.52 | 57.6 |
| Comparative Example 11 | 1.85 | 3.55 | 58.5 |
| Comparative Example 12 | 1.87 | 3.54 | 57.5 |
| Comparative Example 13 | 1.80 | 3.55 | 58.7 |
| Comparative Example 14 | 1.82 | 3.59 | 58.0 |
| Comparative Example 15 | 1.83 | 3.54 | 58.5 |
| Comparative Example 16 | 1.80 | 3.54 | 57.1 |
| Example 26 | 1.85 | 3.50 | 58.0 |

TABLE 3-continued

| | | | |
|---|---|---|---|
| Example 27 | 1.85 | 3.52 | 58.0 |
| Example 28 | 1.82 | 3.56 | 58.2 |
| Example 29 | 1.83 | 3.55 | 58.3 |
| Example 30 | 1.82 | 3.50 | 58.3 |
| Example 31 | 1.87 | 3.52 | 57.6 |
| Example 32 | 1.85 | 3.50 | 57.6 |

| Examples and Comparative Examples | Properties of magnetic carrier | | |
|---|---|---|---|
| | Residual magnetization ($Am^2/kg$) | Electric resistance ($\Omega \cdot cm$) | Water content (%) |
| Example 15 | 5.0 | 7.9E+10 | 0.56 |
| Example 16 | 5.0 | 7.3E+11 | 0.55 |
| Example 17 | 4.9 | 1.2E+12 | 0.60 |
| Comparative Example 8 | 5.0 | 1.1E+15 | 0.53 |
| Comparative Example 9 | 5.1 | 2.3E+10 | 0.56 |
| Comparative Example 10 | 5.0 | 3.8E+10 | 0.60 |
| Example 18 | 4.9 | 1.0E+12 | 0.57 |
| Example 19 | 5.0 | 1.5E+11 | 0.57 |
| Example 20 | 5.1 | 6.8E+10 | 0.57 |
| Example 21 | 5.0 | 7.2E+12 | 0.55 |
| Example 22 | 5.0 | 9.2E+11 | 0.58 |
| Example 23 | 5.0 | 1.7E+11 | 0.60 |
| Example 24 | 5.2 | 6.8E+11 | 0.60 |
| Example 25 | 4.9 | 6.5E+12 | 0.57 |
| Comparative Example 11 | 5.1 | 2.7E+14 | 0.62 |
| Comparative Example 12 | 4.8 | 5.0E+10 | 0.60 |
| Comparative Example 13 | 4.7 | 5.0E+10 | 0.55 |
| Comparative Example 14 | 4.9 | 3.8E+10 | 0.56 |
| Comparative Example 15 | 5.0 | 9.2E+13 | 0.63 |
| Comparative Example 16 | 4.7 | 5.0E+10 | 0.61 |
| Example 26 | 5.1 | 2.3E+12 | 0.59 |
| Example 27 | 5.1 | 6.8E+11 | 0.58 |
| Example 28 | 5.0 | 1.2E+11 | 0.58 |
| Example 29 | 5.0 | 1.7E+11 | 0.53 |
| Example 30 | 5.0 | 2.0E+11 | 0.55 |
| Example 31 | 5.0 | 2.3E+13 | 0.55 |
| Example 32 | 4.9 | 1.0E+13 | 0.53 |

| Examples and Comparative Examples | Machine evaluation | | |
|---|---|---|---|
| | Rate of change in charge amount | Rate of change in electric resistance | Coating condition |
| Example 15 | A | A | A |
| Example 16 | A | A | A |
| Example 17 | A | A | A |
| Comparative Example 8 | E | E | C |
| Comparative Example 9 | E | D | C |
| Comparative Example 10 | E | D | C |
| Example 18 | A | A | A |
| Example 19 | A | A | A |
| Example 20 | A | A | A |
| Example 21 | A | B | B |
| Example 22 | A | A | A |
| Example 23 | A | A | A |
| Example 24 | A | A | A |
| Example 25 | A | B | B |
| Comparative Example 11 | E | E | C |
| Comparative Example 12 | E | D | C |
| Comparative Example 13 | E | D | C |
| Comparative Example 14 | E | D | C |
| Comparative Example 15 | E | E | C |
| Comparative Example 16 | E | D | C |
| Example 26 | A | A | B |
| Example 27 | A | B | A |
| Example 28 | A | B | A |
| Example 29 | A | B | A |
| Example 30 | A | A | A |
| Example 31 | B | B | B |
| Example 32 | B | B | B |

Note
*1: Silicone-based resin;
*2: Acrylic resin;
*3: Styrene-acrylic resin

From the above evaluation results, it was confirmed that in the magnetic carrier and developer according to the present invention, a coating resin was allowed to strongly adhere onto a surface of respective spherical composite particles, the coating resin layer was free from peeling and the like, and it was possible to decrease occurrence of spent toner onto the magnetic carrier, and therefore they had an excellent durability.

INDUSTRIAL APPLICABILITY

In the magnetic carrier core material according to the present invention which is well controlled in surface properties thereof, a coating resin is allowed to strongly adhere onto a surface of respective magnetic carrier core material particles, the coating resin layer is free from peeling and the like, the magnetic carrier can exhibit a stable electric charging characteristic, and occurrence of spent toner onto the magnetic carrier can be suppressed. As a result, the magnetic carrier core material according to the present invention is suitable as a magnetic carrier core material for an electrophotographic developer.

In the magnetic carrier according to the present invention which is well controlled in surface properties of the magnetic carrier core material, a coating resin is allowed to strongly adhere onto a surface of respective magnetic carrier core material particles, the coating resin layer is free from peeling and the like, the magnetic carrier can exhibit a stable charging characteristic, and occurrence of spent toner onto the magnetic carrier can be suppressed. As a result, the magnetic carrier according to the present invention is suitable as a magnetic carrier for an electrophotographic developer.

In the two-component system developer according to the present invention which comprises a magnetic carrier which is well controlled in surface properties of the magnetic carrier core material, a coating resin is allowed to strongly adhere onto a surface of respective magnetic carrier core material particles, the coating resin layer is free from peeling and the like, the two-component system developer can exhibit a stable charging characteristic, and occurrence of spent toner onto the magnetic carrier can be suppressed. As a result, the two-component system developer according to the present invention is suitable as an electrophotographic developer comprising the magnetic carrier for an electrophotographic developer and a toner.

The invention claimed is:

1. A core material of a magnetic carrier for an electrophotographic developer comprising spherical composite particles comprising ferromagnetic iron oxide fine particles in a content of 80 to 99% by weight based upon a weight of a magnetic carrier core material, wherein the ferromagnetic iron oxide fine particles have a single average particle diameter, the single average particle diameter being in a range of 0.05 to 2.0 μm, and a cured phenol resin, wherein the core material has an average particle diameter of 1 to 100 μm, the core material has a resin index within the range of 38 to 80%, the core material has a specific gravity of 2.5 to 4.0, and the core material has a shape factor SF-2 of 100 to 120, the shape factor SF-2 being determined by Formula (1):

$$SF\text{-}2=(\text{peripheral length of particles})^2/(\text{projected area of particles})\times(1/4\pi)\times 100 \quad (1).$$

2. The core material of a magnetic carrier for an electrophotographic developer according to claim 1, wherein a contact angle of the spherical composite particles to water is within the range of 90 to 100°.

3. A magnetic carrier for an electrophotographic developer comprising particles of the core material of a magnetic carrier for an electrophotographic developer as claimed in claim 1, and a coating resin layer formed on a surface of the respective particles of the core material.

4. The magnetic carrier for an electrophotographic developer according to claim 3, wherein the coating resin is at least one resin selected from the group consisting of a silicone-based resin, an acrylic resin, a styrene-acrylic resin.

5. A two-component system developer comprising the magnetic carrier as claimed in claim 3 and a toner.

6. A process for producing the core material of a magnetic carrier for an electrophotographic developer as claimed in claim 1, comprising the steps of:

reacting at least ferromagnetic iron oxide fine particles, a phenol compound and an aldehyde compound with each other in an aqueous medium in the presence of a basic catalyst to produce spherical composite particles comprising the ferromagnetic iron oxide fine particles and a cured phenol resin; and subjecting the thus produced spherical composite particles to heat treatment in a temperature range of 150 to 250° C. under a reduced pressure of 40 to 80 kPa in an inert atmosphere.

7. The core material of a magnetic carrier for an electrophotographic developer according to claim 1, wherein the shape factor SF-2 of the core material is 100 to 110.

8. A process for producing the core material of a magnetic carrier for an electrophotographic developer as claimed in claim 1, comprising the steps of:

reacting at least ferromagnetic iron oxide fine particles, a phenol compound and an aldehyde compound with each other in an aqueous medium in the presence of a basic catalyst to produce spherical composite particles comprising the ferromagnetic iron oxide fine particles and a cured phenol resin; and subjecting the thus produced spherical composite particles to heat treatment in a temperature range of 150 to 250° C. under a reduced pressure of 40 to 80 kPa in an inert atmosphere.

9. The core material of a magnetic carrier for an electrophotographic developer according to claim 1, wherein the specific gravity is 3.0 to 4.0.

10. The core material of a magnetic carrier for an electrophotographic developer according to claim 1, wherein the resin index of the spherical composite particles is within the range of 40 to 80%.

11. The core material of a magnetic carrier for an electrophotographic developer according to claim 1, wherein the resin index of the spherical composite particles is within the range of 45 to 80%.

* * * * *